US008979576B2

(12) United States Patent
Nonen et al.

(10) Patent No.: US 8,979,576 B2
(45) Date of Patent: Mar. 17, 2015

(54) CABLE CONNECTOR AND CABLE ASSEMBLY, AND METHOD OF MANUFACTURING CABLE ASSEMBLY

(71) Applicant: Hitachi Cable, Ltd., Tokyo (JP)

(72) Inventors: Hideki Nonen, Hitachi (JP); Yosuke Ishimatsu, Hitachi (JP); Kei Nishimura, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 79 days.

(21) Appl. No.: 13/795,326

(22) Filed: Mar. 12, 2013

(65) Prior Publication Data

US 2014/0154928 A1 Jun. 5, 2014

(30) Foreign Application Priority Data

Nov. 30, 2012 (JP) ..... 2012-261955

(51) Int. Cl.

| | |
|---|---|
| ***H01R 3/00*** | (2006.01) |
| ***H01R 43/26*** | (2006.01) |
| ***H01R 4/04*** | (2006.01) |
| ***H01R 9/03*** | (2006.01) |
| *H01R 12/62* | (2011.01) |
| *H01R 43/02* | (2006.01) |

(52) U.S. Cl.

CPC ..... *H01R 43/26* (2013.01); *H01R 4/04* (2013.01); *H01R 9/034* (2013.01); *H01R 12/62* (2013.01); *H01R 43/0207* (2013.01)

USPC ..... 439/497

(58) Field of Classification Search

USPC ..... 439/497, 581, 108

See application file for complete search history.

(56) References Cited

U.S. PATENT DOCUMENTS 6,489,563 B1 * 12/2002 Zhao et al. ..... 174/88 C
2012/0061140 A1 3/2012 Nonen et al.

FOREIGN PATENT DOCUMENTS

JP 2012-99434 5/2012

* cited by examiner

*Primary Examiner* — Phuong Dinh

(74) *Attorney, Agent, or Firm* — Antonelli, Terry, Stout & Kraus, LLP.

(57) ABSTRACT

Provided is a cable connector, a cable assembly, and a method of manufacturing the cable assembly, in which electric characteristics are stabilized by suppressing elastic deformation of a cable for differential signal transmission, and besides, which is easily connectable by reducing the number of parts. In a ground contact, an outer-conductor adhering portion which is protruded from a side wall portion of a connector main body and which is adhered with an outer conductor by a conductive adhesive is provided. In this manner, elastic deformation of a cable for differential signal transmission is suppressed, so that electric characteristics can be stabilized. Also, connecting work between the outer conductor and the ground contact can be simplified as reducing the number of parts. Further, the cable for differential signal transmission is not exposed to a high temperature of soldering or others, and therefore, thermal deformation thereof does not occur, either.

12 Claims, 15 Drawing Sheets

CABLE CONNECTOR AND CABLE ASSEMBLY, AND METHOD OF MANUFACTURING CABLE ASSEMBLY

CROSS-REFERENCE TO RELATED APPLICATION

The present application claims priority from Japanese Patent Application No. 2012-261955 filed on Nov. 30, 2012, the content of which is hereby incorporated by reference into this application.

TECHNICAL FIELD OF THE INVENTION

The present invention relates to a cable connector provided with a pair of signal line conductors and electrically connected with a cable for differential signal transmission which transmits differential signals whose phases are inverted to each other by an angle of 180°, relates to a cable assembly provided with the cable for differential signal transmission and the cable connector, and relates to a method of manufacturing the cable assembly.

BACKGROUND OF THE INVENTION

Conventionally, a differential interface standard such as LVDS (Low Voltage Differential Signal) is adopted in a device such as a server, a rooter, and a storage product, which handles a high-rate digital signal of several Gbit/s or higher, and differential signals are transmitted by using a cable for differential signal transmission between respective devices or respective circuit boards inside the device. The differential signals have such a feature that exogenous-noise immunity is high as reducing a voltage of a system power supply.

The cable for differential signal transmission is provided with a pair of signal line conductors, and a plus-side (positive) signal and a minus-side (negative) signal whose phases are inverted to each other by an angle of 180° are transmitted to the respective signal line conductors. And, a potential difference between these two signals (the plus-side signal and the minus-side signal) becomes a signal level, and the signal level is recognized on a reception side as, for example, "High" if the potential difference is positive and "Low" if the potential difference is negative.

As a technique which discloses a cable for differential signal transmission for transmitting such differential signals, a technique described in, for example, Japanese Patent Application Laid-Open Publication No. 2012-099434 (FIGS. 1 and 2, Patent Document 1) is known. In the technique described in the Patent Document 1, a pair of signal line conductors arranged in parallel to each other at a predetermined interval are provided, and these respective signal line conductors are covered with an insulator. That is, the respective signal line conductors are held in parallel to each other at the predetermined interval by the insulator. Further, periphery of the insulator is covered with a sheet-shaped outer conductor, and besides, periphery of the outer conductor is covered with a sheath (protective outer coat).

And, by sequentially stripping one end side of the cable for differential signal transmission in tiers, portions of the respective signal line conductors and the outer conductor are exposed outside. The exposed portion of the outer conductor is connected with a metallic shield connection terminal by swaging. The shield connection terminal is provided with a plate-shaped metal and a solder connection pin formed integrally with the plate-shaped metal, and the plate-shaped metal is plastically deformed so as to be along with the shape of the outer conductor in the swaging. In this manner, the outer conductor and the shield connection terminal are electrically connected to each other, so that the outer conductor can be electrically connected to a ground pad of a circuit board via the shield connection terminal (the plate-shaped metal and the solder connection pin).

SUMMARY OF THE INVENTION

In the technique described in the above-described Patent Document 1, for the direct connection of the outer conductor to the ground pad by soldering, heat (about 350° C.) at a tip of a soldering bit used for the soldering-connection work is not in contact with the outer conductor, and therefore, it can be suppressed that the insulator is deformed or melted by the heat at the tip of the soldering bit. However, since the shield connection terminal is swaged along with the shape of the outer conductor, the insulator inside the outer conductor is elastically deformed by a swaging force in some cases, which results in occurrence of a problem in manufacture such as change of a distance between the respective signal line conductors inside the insulator. As a result, a problem of variation in electric characteristics among the cables for differential signal transmission may occur for each product.

A preferred aim of the present invention is to provide a cable connector, a cable assembly, and a method of manufacturing the cable assembly, whose electric characteristics are stabilized by suppressing elastic deformation of a cable for differential signal transmission and which is easily connectable by reducing the number of parts.

A cable connector of the present invention has a feature of a cable connector which is electrically connected with a cable for differential signal transmission including: a pair of signal line conductors; an insulator provided in peripheries of the respective signal line conductors; and an outer conductor provided in periphery of the insulator, and the cable connector includes: a connector board made of an insulating material; a pair of signal line contacts which are provided in the connector board and are electrically connected with the respective signal line conductors; a ground contact which is provided in the connector board and is electrically connected with the outer conductor; and an outer-conductor adhering portion which is provided in the ground contact, is protruded from a side wall portion of the connector board, and is adhered with the outer conductor by a conductive adhesive.

The cable connector of the present invention has a feature that the ground contact is extended in a longitudinal direction of the respective signal line contacts so that peripheries of the respective signal line contacts except for a part thereof are covered with the ground contact.

The cable connector of the present invention has a feature that the respective signal line contacts are protruded from the side wall portion of the connector board toward the outer-conductor adhering portion.

The cable connector of the present invention has a feature that a positioning wall portion for positioning the outer conductor is provided in the outer-conductor adhering portion.

The cable connector of the present invention has a feature that peripheries of the outer-conductor adhering portion and the outer conductor are solidified by an insulating material under a state that the outer conductor is arranged in the outer-conductor adhering portion.

The cable connector of the present invention has a feature that a tape having conductive property is wound in the peripheries of the outer-conductor adhering portion and the outer conductor.

A cable assembly of the present invention is a cable assembly including a cable for differential signal transmission and a cable connector which is electrically connected with the cable for differential signal transmission, the cable for differential signal transmission includes: a pair of signal line conductors; an insulator provided in peripheries of the respective signal line conductors; and an outer conductor provided in periphery of the insulator, and the cable connector includes: a connector board made of an insulating material; a pair of signal line contacts which are provided in the connector board and are electrically connected with the respective signal line conductors; a ground contact which is provided in the connector board and is electrically connected with the outer conductor; and an outer-conductor adhering portion which is provided in the ground contact, is protruded from a side wall portion of the connector board, and is adhered with the outer conductor by a conductive adhesive.

The cable assembly of the present invention has a feature that the ground contact is extended in a longitudinal direction of the respective signal line contacts so that peripheries of the respective signal line contacts except for a part thereof are covered with the ground contact.

The cable assembly of the present invention has a feature that each of the signal line contacts is protruded from the side wall portion of the connector board toward the outer-conductor adhering portion.

The cable assembly of the present invention has a feature that a positioning wall portion for positioning the outer conductor is provided in the outer-conductor adhering portion.

The cable assembly of the present invention has a feature that peripheries of the outer-conductor adhering portion and the outer conductor are solidified by an insulating material under a state that the outer conductor is arranged in the outer-conductor adhering portion.

The cable assembly of the present invention has a feature that a tape having conductive property is wound in the peripheries of the outer-conductor adhering portion and the outer conductor.

A method of manufacturing a cable assembly of the present invention has a feature of steps including: a cable preparing step of preparing a cable for differential signal transmission including a pair of signal line conductors, an insulator provided in peripheries of the respective signal line conductors, and an outer conductor provided in periphery of the insulator; a cable-connector preparing step of preparing a cable connector including a connector board made of an insulating material, a pair of signal line contacts which are provided in the connector board and are electrically connected with the respective signal line conductors, a ground contact which is provided in the connector board and is electrically connected with the outer conductor, and an outer-conductor adhering portion which is provided in the ground contact, is protruded from a side wall portion of the connector board, and is adhered with the outer conductor by a conductive adhesive; an adhesive applying step of applying the conductive adhesive on the outer-conductor adhering portion; and a connecting step of arranging the outer conductor in the outer-conductor adhering portion on which the conductive adhesive has been applied and of arranging the respective signal line conductors in the respective signal line contacts so that the respective signal line conductors and the respective signal line contacts are electrically connected with each other.

The method of manufacturing the cable assembly of the present invention has a feature that the connecting step is followed by performing a mold forming step of solidifying the peripheries of the outer-conductor adhering portion and the outer conductor by an insulating material.

According to the present invention, the outer-conductor adhering portion is provided in the ground contact so as to be protruded from the side wall portion of the connector board and to be adhered with the outer conductor by the conductive adhesive, and therefore, it is not required to swage the shield connection terminal so as to be along with the shape of the outer conductor as conventional, so that the electric characteristics can be stabilized by suppressing the elastic deformation of the cable for differential signal transmission. Also, the conventional shield connection terminal is not required, and therefore, the connection work between the outer conductor and the ground contact can be simplified as reducing the number of parts. Further, the soldering connection work for electrically connecting the outer conductor with the ground contact is not required, either, and therefore, thermal deformation of the cable for differential signal transmission due to exposure to a high temperature is prevented.

BRIEF DESCRIPTIONS OF THE DRAWINGS

DESCRIPTIONS OF THE PREFERRED EMBODIMENTS

Hereinafter, a first embodiment of the present invention will be explained in detail with reference to the drawings.

Figure 1:
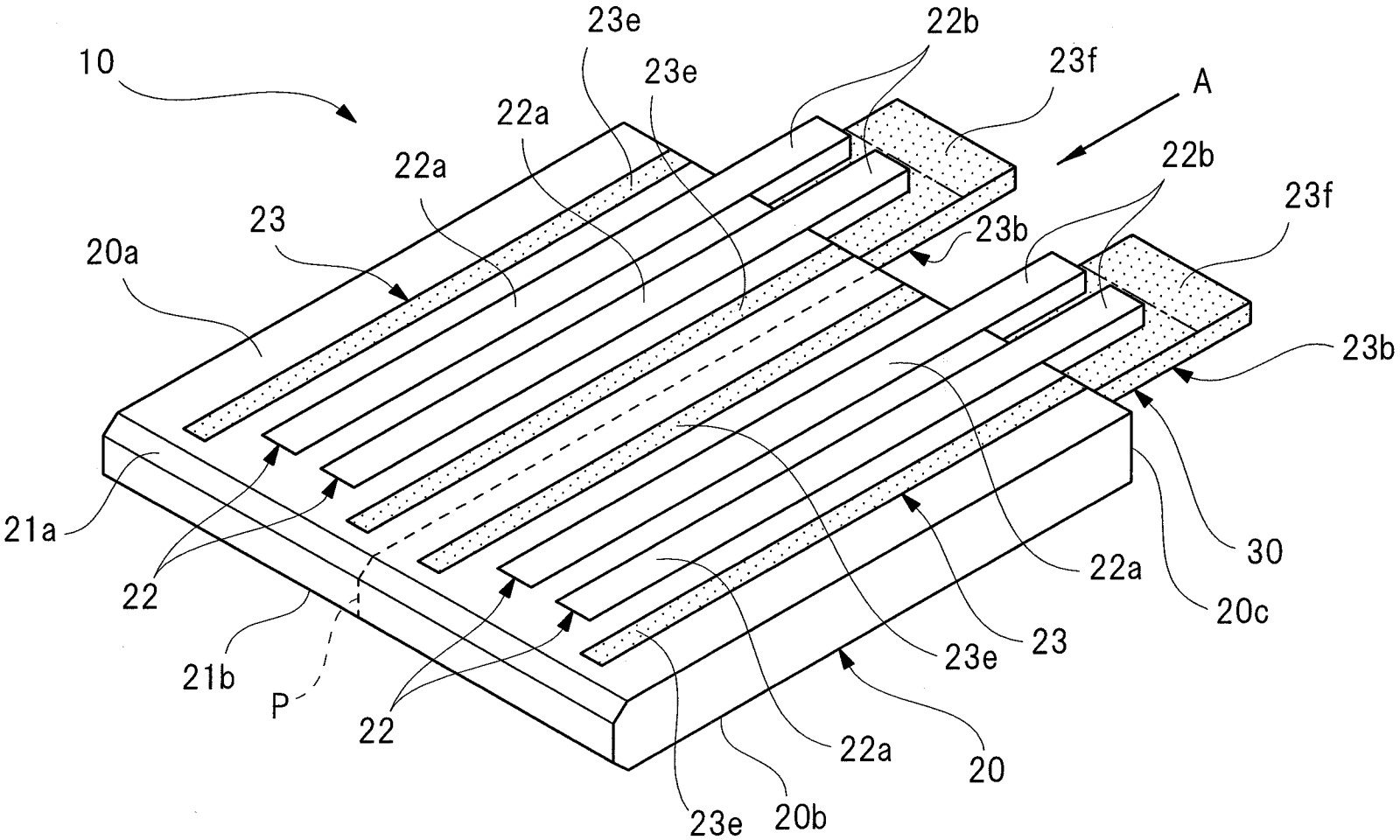
FIG. 1 is a perspective view of a cable connector according to a first embodiment as viewed from a front side.
Figure 2:
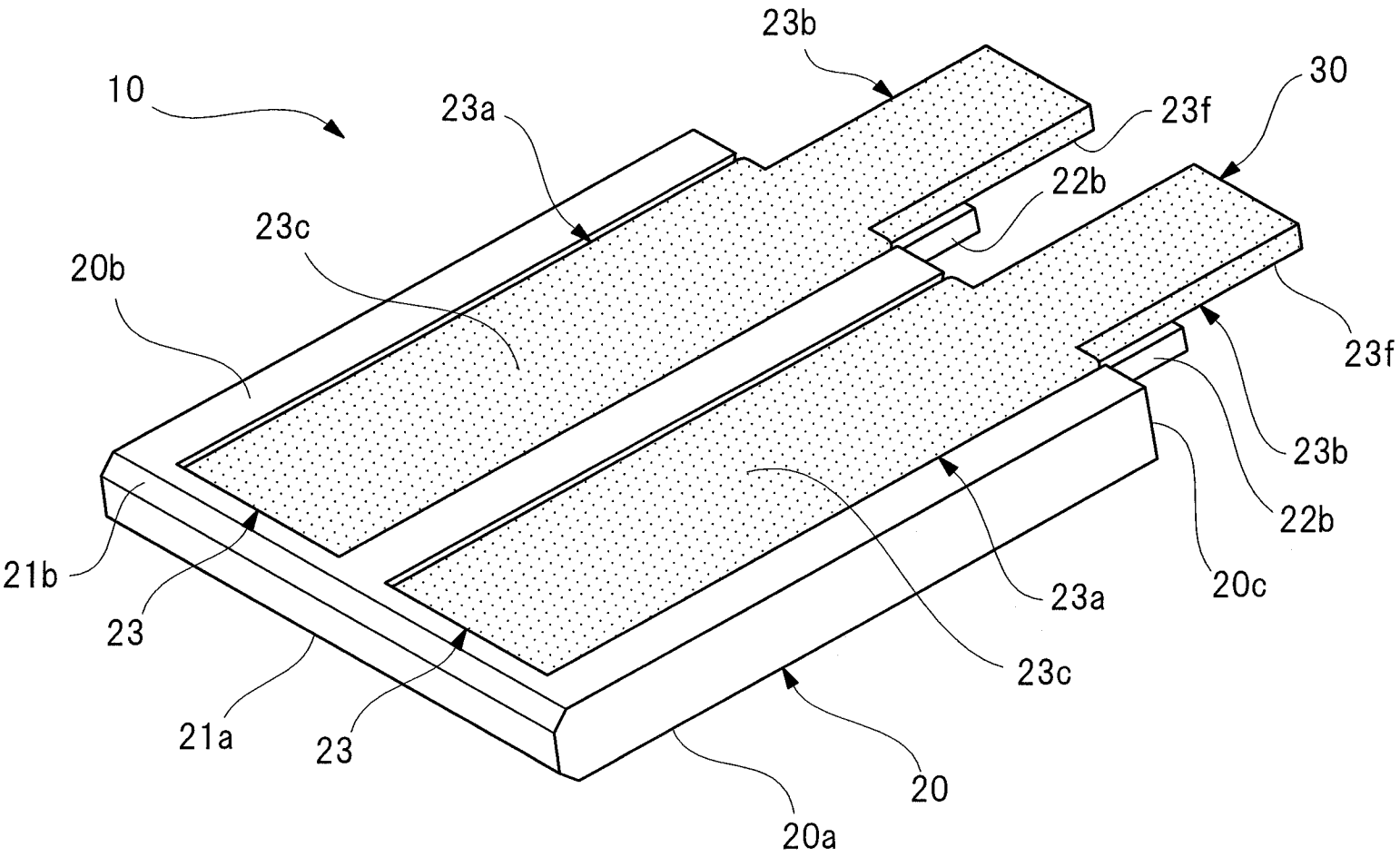
FIG. 2 is a perspective view of the cable connector of FIG. 1 as viewed from a rear side.
Figure 3:
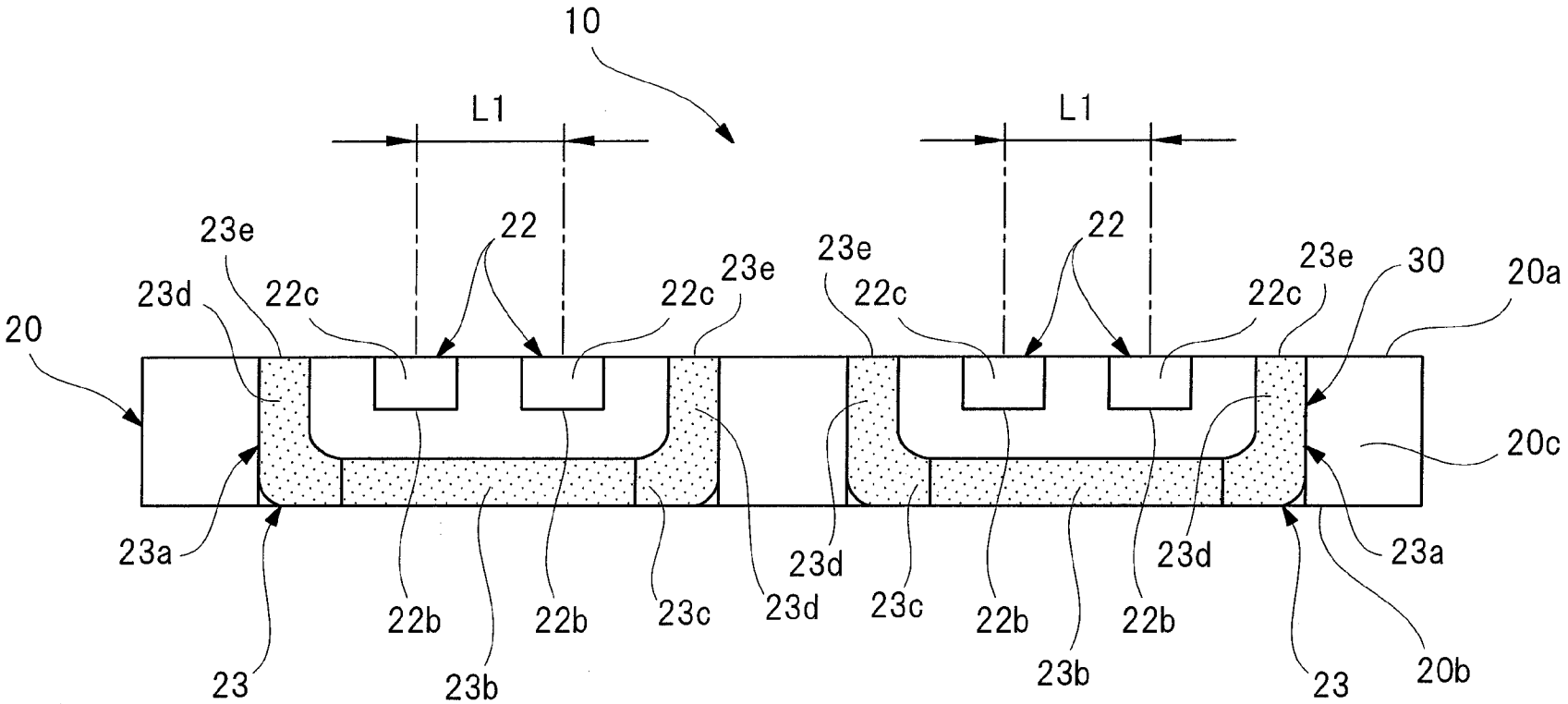
FIG. 3 is a side view on an arrow A in FIG. 1.
Figure 4A:
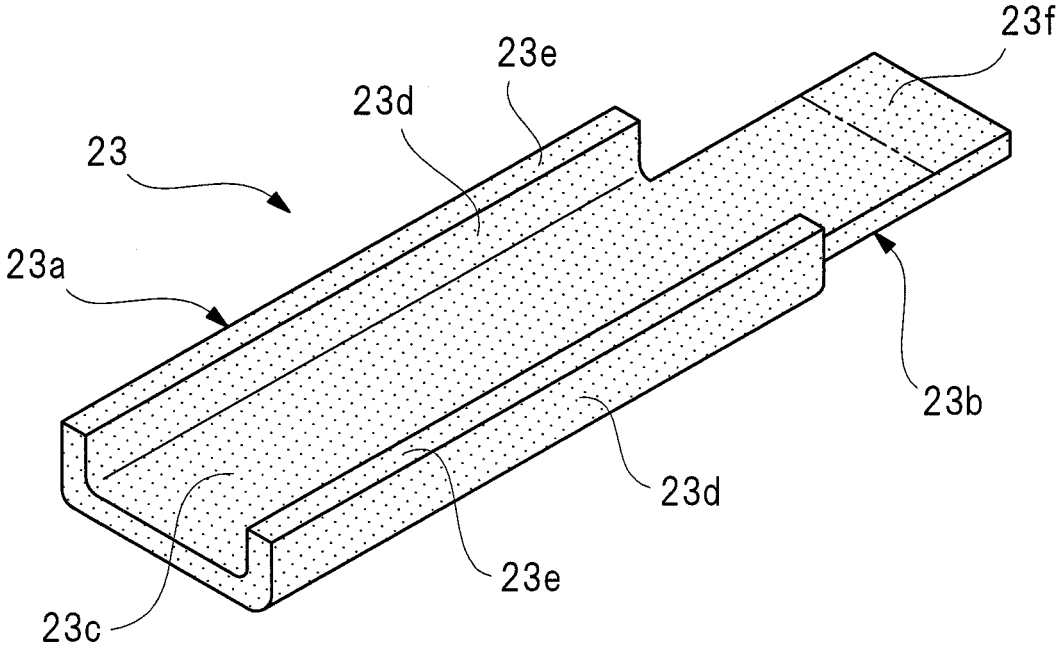
FIG. 4A is a perspective view of a ground contact as viewed from a front side.
Figure 4B:
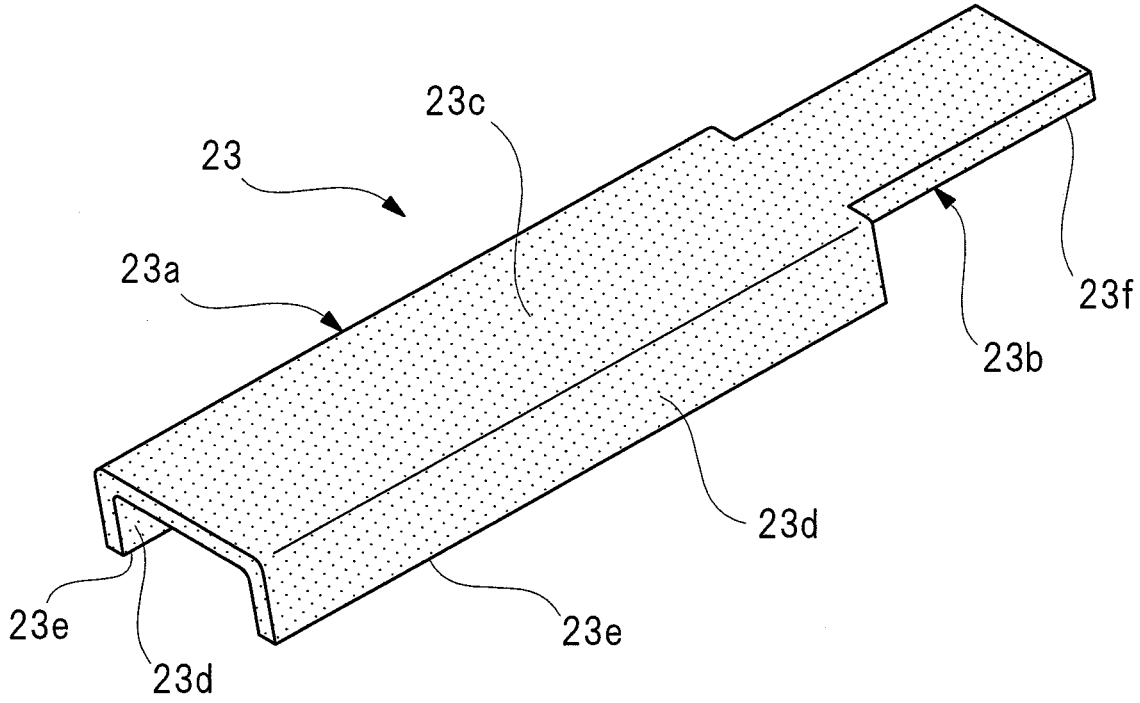
FIG. 4B is a perspective view of the ground contact as viewed from a rear side.
Figure 5A:
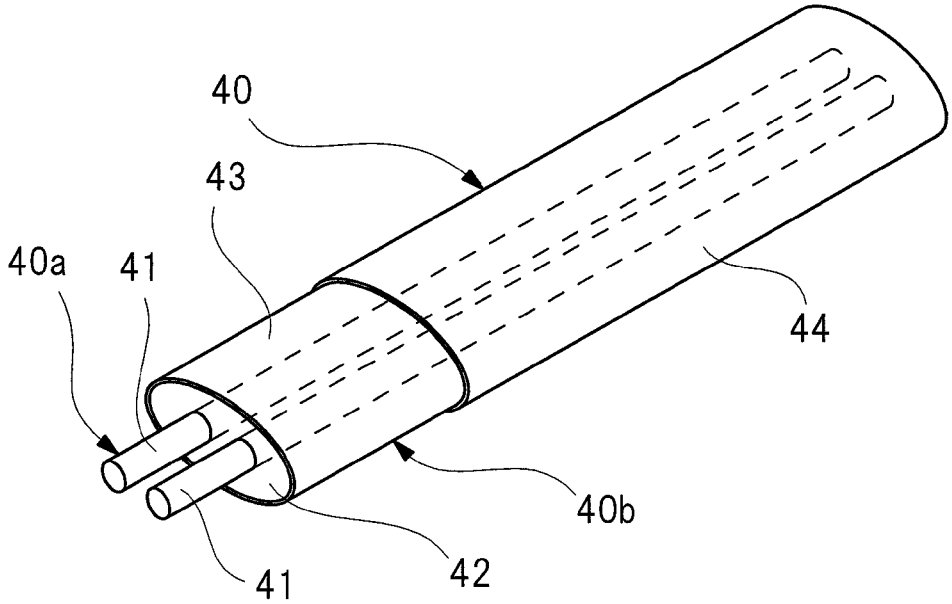
FIG. 5A is a perspective view of a cable for differential signal transmission.
Figure 5B:
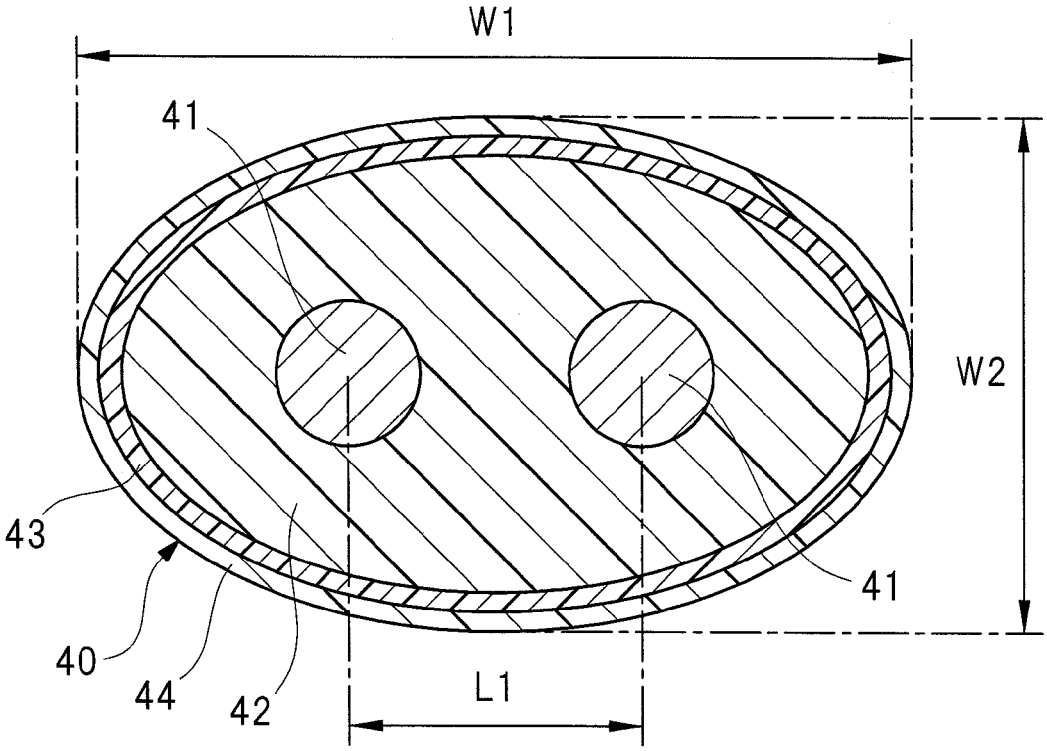
FIG. 5B is a cross-sectional view of the cable for differential signal transmission.
Figure 6:
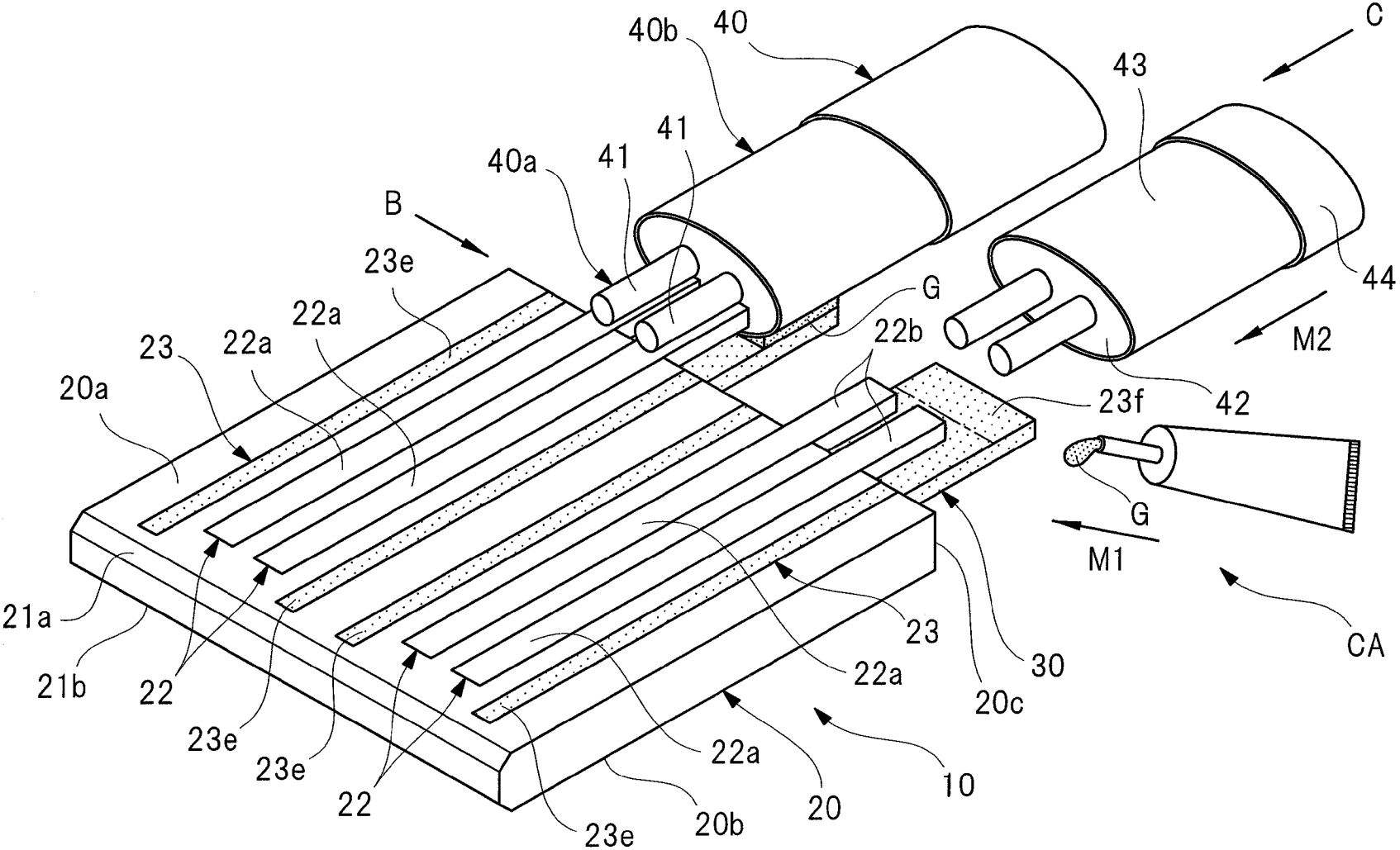
FIG. 6 is a perspective view for explaining a manufacturing procedure (assembling procedure) of a cable assembly.
Figure 7:
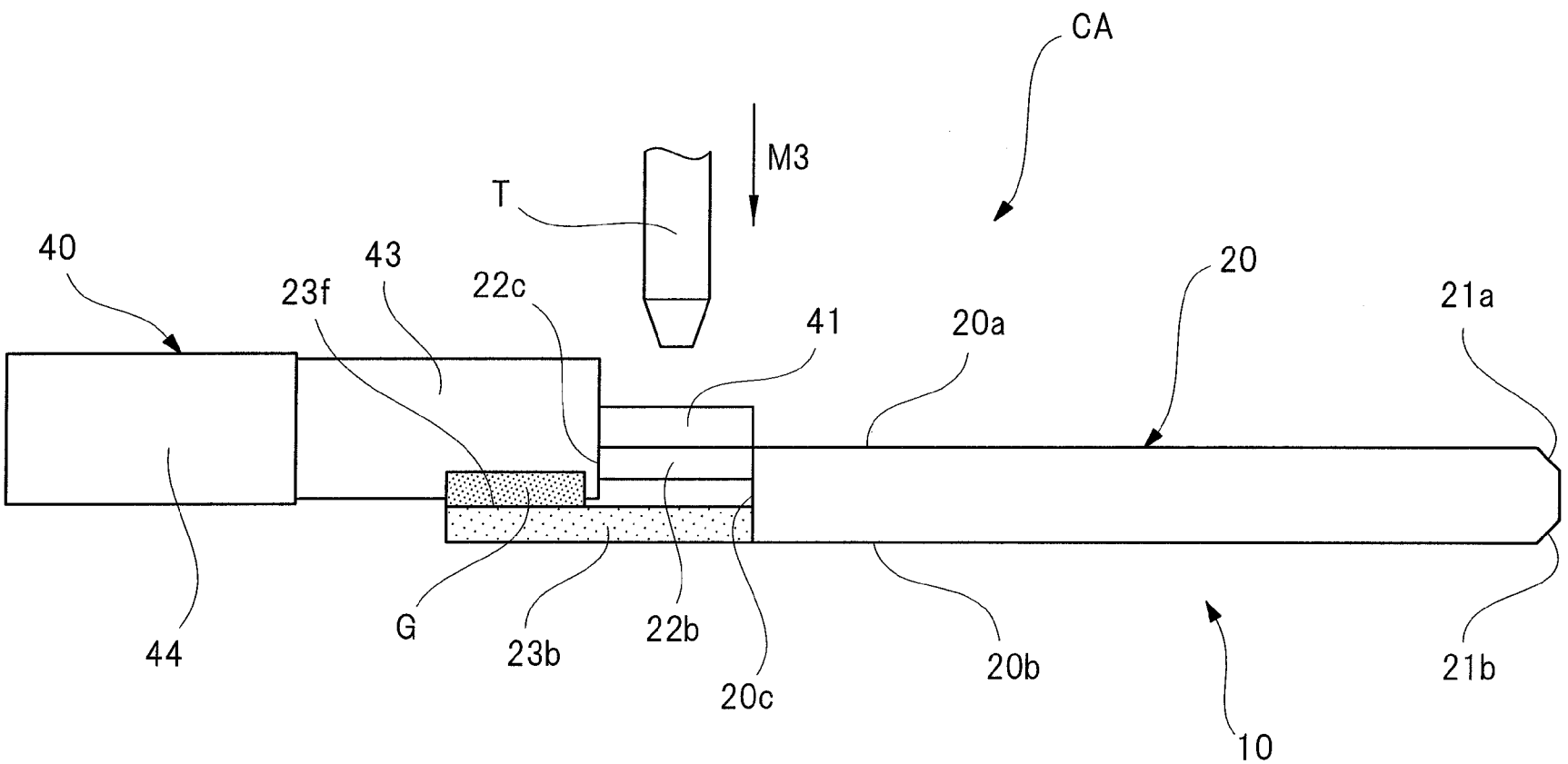
FIG. 7 is a side view on an arrow B in FIG. 6.
Figure 8:
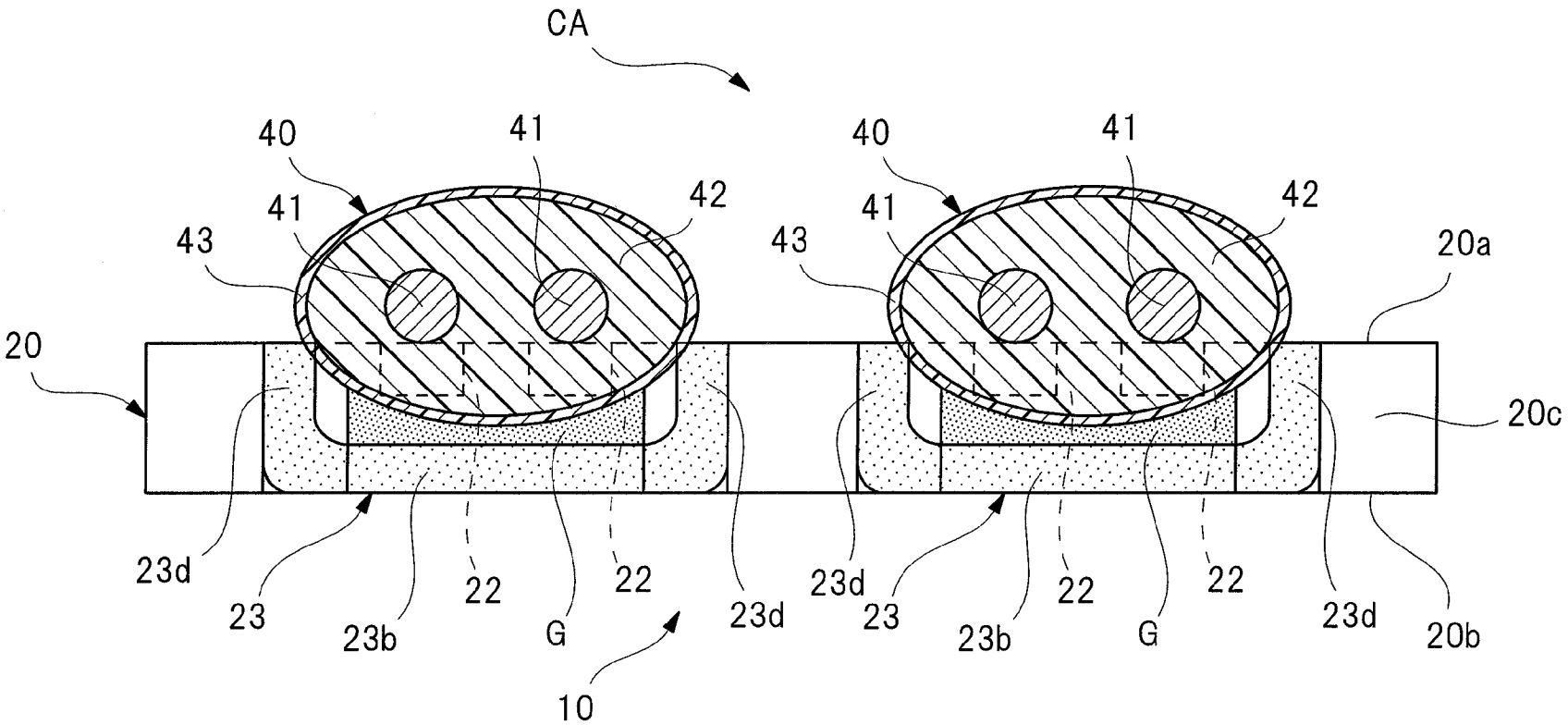
FIG. 8 is a side view on an arrow C in FIG. 6.

FIG. 1 is a perspective view of a cable connector according to the first embodiment as viewed from a front side, FIG. 2 is a perspective view of the cable connector of FIG. 1 as viewed from a rear side, FIG. 3 is a side view on an arrow A in FIG. 1, FIG. 4A is a perspective view of a ground contact as viewed from a front side, FIG. 4B is a perspective view of the ground contact as viewed from a rear side, FIG. 5A is a perspective view of a cable for differential signal transmission, FIG. 5B is a cross-sectional view of the cable for differential signal transmission, FIG. 6 is a perspective view for explaining a manufacturing procedure (assembling procedure) of a cable assembly, FIG. 7 is a side view on an arrow B in FIG. 6, and FIG. 8 is a side view on an arrow C in FIG. 6.

As illustrated in FIG. 1 or 3, a cable connector 10 is provided with a connector main body (connector board) 20 and a cable connection portion 30. The connector main body 20 is configured to be inserted into, for example, a slot (socket) provided in a backplane product (not illustrated), and a plurality of cables for differential signal transmission 40 (see FIG. 5) are electrically connected to the cable connection portion 30. Note that two cables for differential signal transmission 40 are electrically connected to the illustrated cable connector 10.

The connector main body 20 is made of an insulating material such as epoxy resin and formed in a plate shape, and has a front-side surface 20*a* and a rear-side surface 20*b*. On tip-end sides of the connector main body 20 in a direction of the insertion into the socket, a pair of taper surfaces 21*a* and 21*b* are formed so as to correspond to the front-side surface 20*a* and the rear-side surface 20*b*. The taper surfaces 21*a* and 21*b* are obtained by forming the tip-end sides of the connector main body 20 in the insertion direction in a tapered shape so that the insertion of the connector main body 20 into the socket is guided.

In the connector main body 20, four signal line contacts 22 and two ground contacts 23 are provided so as to extend from each of the taper surfaces 21*a* and 21*b* sides toward an opposite side to each of the taper surfaces 21*a* and 21*b* sides. Here, in order to easily distinguish the respective signal line contacts 22 from the respective ground contacts 23, hatching is added to each of the respective ground contacts 23 as illustrated.

Also, one cable for differential signal transmission 40 and the other cable for differential signal transmission 40 correspond to each other on a boundary of a dashed line "P" in the drawing. That is, two signal line contacts 22 and one ground contact 23 are provided so as to correspond to one cable for differential signal transmission 40.

Each signal line contact 22 is formed in a bar shape whose horizontal cross-side surface is quadrangular by pressing a steel plate made of brass having an excellent conductive property or others. Each signal line contact 22 is embedded so as to be closer to the front-side surface 20*a* in a direction of a plate thickness of the connector main body 20 by insert molding, and one side surface 22*a* of each signal line contact 22 is exposed outside from the front-side surface 20*a* or the connector main body 20.

While one part of about ⅘ in a length of each signal line contact 22 is embedded in the connector main body 20, the other part of about ⅕ in the length thereof is protruded from a side wall portion 20*c* of the connector main body 20 toward an outer-conductor adhering portion 23*f* of the ground contact 23. Each signal line conductor 41 (see FIG. 5) of the cable for differential signal transmission 40 is electrically connected with each protruding portion 22*b* protruded from the connector main body 20 of each signal line contact 22. That is, each protruding portion 22*b* forms a cable connection portion 30. In this manner, each signal line contact 22 is extended so as to be bridged between both of the connector main body 20 and the cable connection portion 30.

When the cable for differential signal transmission 40 is connected with the cable connection portion 30, an end portion of the insulator 42 (see FIG. 5) forming the cable for differential signal transmission 40 abuts on a protruding end 22*c* (see FIG. 3) of each protruding portion 22*b* of the respective signal line contacts 22. In this manner, the cable for differential signal transmission 40 can be positioned with respect to the cable connection portion 30 with high accuracy.

Also, by protruding each protruding portion 22*b* from the side wall portion 20*c*, each protruding portion 22*b* of each signal line contact 22 can be easily recognized by an image capturing camera of an automatic assembly device when the cable for differential signal transmission 40 is connected with the cable connection portion 30 by the automatic assembly device (not illustrated). However, each protruding portion 22*b* may be eliminated. In this case, the end portion of the insulator 42 of the cable for differential signal transmission 40 is formed so as to abut on the side wall portion 20*c* of the connector main body 20.

As illustrated in FIG. 4, each ground contact 23 is formed in a predetermined shape by pressing a steel plate made of brass having an excellent conductive property or others, and has a contact main body 23*a* and a protruding plate portion 23*b*. The contact main body 23*a* has a horizontal cross-sectional surface formed in a substantial U shape, and has a base wall portion 23*c* and a pair of side wall portions 23*d* provided integrally with the base wall portion 23*c*. The contact main body 23*a* is embedded in the connector main body 20 by insertion molding so as to extend in a longitudinal direction of each signal line contact 22. And, as illustrated in FIG. 1, each end surface portion 23*e* of each side wall portion 23*d* of the ground contact 23 is exposed outside from the front-side surface 20*a* of the connector main body 20.

As illustrated in FIGS. 1 and 3, inside the substantial U shape of the cross-sectional surface of the contact main body 23*a*, a pair of signal line contacts 22 are arranged through a predetermined space. That is, the contact main body 23*a* forming the ground contact 23 covers each signal line contact 22 except for one side surface 22*a* of the periphery of each signal line contact 22 (a part of the periphery of each signal line contact). In this manner, with preventing the short circuit between each signal line contact 22 and the ground contact 23, the radiation of the exogenous noises from each signal line contact 22 toward outside is prevented, which results in stabilization of the electric characteristics.

Also, as illustrated in FIG. 2, the base wall portion 23*c* of the contact main body 23*a* is exposed outside the connector main body 20. In this manner, by exposing a relative wide area of each ground contact 23 outside, a dimension in a thickness of the connector main body 20 is reduced, and besides, blocking performance for the exogenous noises among the cable connectors 10 obtained when the cable connectors 10 are used to be stacked is improved so that the electric characteristics in the stacking is also stabilized.

The protruding plate portion 23*b* of the ground contact 23 is protruded from the side wall portion 20*c* of the connector main body 20 in the longitudinal direction of the ground contact 23, and its dimension in the protruding length is substantially half (substantially ½) a dimension in a length of the contact main body 23*a*. That is, a portion of substantially ⅔ in the length of the ground contact 23 becomes the contact main body 23*a*, and a portion of substantially ⅓ in the length thereof becomes the protruding plate portion 23*b*. In this manner, the protruding plate portion 23*b* forms the cable connection portion 30, and the ground contact 23 is extended so as to be bridged between both of the connector main body 20 and the cable connection portion 30.

As illustrated in FIG. 1 and a chain-line region of FIG. 4A, the outer-conductor adhering portion 23*f* is provided on the further protruding end side of the protruding plate portion 23*b*. A predetermined amount of a conductive adhesive "G" (see FIG. 6) for electrically connecting the outer conductor 43 (see FIG. 5) of the cable for differential signal transmission 40 is applied to the outer-conductor adhering portion 23*f*. Here, the conductive adhesive G is made of, for example, a conductive material such as gold powder, silver powder, or copper powder and a binder made of epoxy resin or others, which are hardened at a room temperature for use.

The outer-conductor adhering portion 23*f* is formed in a portion of the plate protruding portion 23*b* which is protruded longer than each protruding portion 22*b* of each signal line contact 22, so that the conductive adhesive G is easily applied, and besides, the conductive adhesive G is not in contact with (do not short-circuit to) each signal line contact 22. As described above, the outer conductor 43 of the cable for differential signal transmission 40 is electrically connected with the outer-conductor adhering portion 23*f* by the conductive adhesive G. Therefore, the outer conductor 43 is prevented from being exposed to a high temperature of the soldering as different from a conventional technique.

Note that the ground contact 23 can be easily formed in a shape as illustrated in FIG. 4 by performing the pressing work once so that punching and forming are simultaneously performed. That is, the shape of the ground contact 23 is excellent in mass productivity.

As illustrated in FIG. 5, the cable for differential signal transmission 40 is provided with a pair of signal line conductors 41. While a plus-side (positive) signal as a differential signal is transmitted to either one of the respective signal line conductors 41, a minus-side (negative) signal as a differential signal is transmitted to the other of the respective signal line conductors 41. Each signal line conductor 41 is formed of, for example, an annealed (soft) copper wire whose surface has been subjected to tin-plating treatment (which is a tinned annealed copper wire), and each signal line conductor 41 is covered with an insulator 42.

The insulator 42 is made of, for example, foamed polyethylene in order to provide flexibility to the cable for differential signal transmission 40, a horizontal cross-sectional shape thereof is formed in a substantial oval shape. The insulator 42 holds the respective signal line conductors 41 so as to arrange them at a predetermined interval, and the insulator 42 is provided in the peripheries of the respective signal line conductors 41 so as to have thicknesses which are substantially equal to each other.

However, the horizontal cross-sectional shape of the insulator 42 is not limited to the substantial oval shape as illustrated, and may be, for example, a substantial circular shape obtained by individually coating each of the signal line conductors 41. Further, the horizontal cross-sectional shape of the insulator 42 may be a shape which is substantially equal to, for example, a track of an athletics track field formed of a pair of parallel lines having the same length and a pair of semicircular shapes.

An outer conductor 43 for suppressing influence of the exogenous noises is provided in the periphery of the insulator 42. The outer conductor 43 is made of, for example, a sheet-shaped copper foil, and covers most of the insulator 42 except for end portions in the longitudinal direction of the insulator 42. However, the outer conductor 43 is not limited to the copper foil, and may be another metal foil, and further, may be a braided sheet obtained by braiding a metal thin wire such as an annealed copper wire.

A sheath 44 serving as a protective outer coat for protecting the cable for differential signal transmission 40 is provided in the periphery of the outer conductor 43, and the sheath 44 covers most of the outer conductor 43 except for end portions of the outer conductor 43 in the longitudinal direction thereof. Note that the sheath 44 is made of, for example, heat resistant polyvinyl chloride (PVC). Further, the cable for differential signal transmission 40 does not include a drain line.

As illustrated in FIG. 5, a signal-line conductor exposure portion 40*a* from which the respective signal line conductors 41 are exposed outside and an outer conductor exposure portion 40*b* from which the outer conductor 43 is exposed outside by sequentially stripping them in tiers in the longitudinal direction are provided at the end portion of the cable for differential signal transmission 40. That is, the signal-line conductor exposure portion 40*a* and the outer conductor exposure portion 40*b* are aligned in this order from the end portion of the cable for differential signal transmission 40.

A length "L1" of a line which connects between center portions of the respective signal line conductors 41 is set to be equal to a length "L1" (see FIG. 3) of a line which connects between center portions of the respective signal line contacts 22 (L1=L1). In this manner, the respective signal line conductors 41 can be electrically and securely in contact with the respective signal line contacts 22. Here, if both lengths are made different from each other, such a problem that one signal line conductor 41 and one signal line contact 22 cannot be connected to each other due to a position shift between the both of them may occur.

Also, a ratio of "W1" which is a dimension in a length of a long axis of the cable for differential signal transmission 40 (which is a dimension in a width thereof) and "W2" which is a dimension in a length of a short axis thereof (which is a dimension in a thickness thereof) is set to a relation of "about W1: W2=1.6:1". In this manner, as connecting the respective signal line conductors 41 with the respective signal line contacts 22, the outer conductor 43 can be connected with the ground contact 23.

Next, a method of connecting between the cable connector 10 and the cable for differential signal transmission 40 formed as described above, that is, a method of manufacturing a cable assembly "CA" (see FIG. 6) will be described in detail with reference to the drawings.

[Cable Preparing Step]

First, the cable for differential signal transmission 40 (see FIG. 5) including: the respective signal line conductors 41; the insulator 42; the outer conductor 43; and the sheath 44, is prepared. And, the signal-line conductor exposure portion 40*a* and the outer conductor exposure portion 40*b* are formed by sequentially stripping the end portion of the prepared cable for differential signal transmission 40 in tiers as illustrated in FIG. 5. In this manner, the cable preparing step is completed.

[Cable Connector Preparing Step]

Next, the above-described cable connector 10 (see FIG. 1 or 3) to which two cables for differential signal transmission 40 can be electrically connected is prepared. In this manner, the cable connector preparing step is completed. Here, cable connectors having a plurality of specifications may be prepared in accordance with the connection number of the cable for differential signal transmission 40 such as three-line connection and four-line connection, and can be appropriately selected in accordance with the required specification.

Note that, since the cable for differential signal transmission 40 and the cable connector 10 are prepared independently from each other in the [Cable Preparing Step] and the [Cable Connector Preparing Step] described above, an order of these steps may be changed. That is, the [Cable Connector Preparing Step] may be performed first, and then, the [Cable Preparing Step] may be performed.

[Adhesive Applying Step]

Next, as illustrated by an arrow "M1" of FIG. 6, a predetermined amount of the conductive adhesive G is applied onto the outer-conductor adhering portion 23*f*. Here, the application of the conductive adhesive G onto the outer-conductor adhering portion 23*f* may be manually performed by an assembly worker, or may be automatically performed by an adhesive dispenser (not illustrated) of the automatic assembly device. In this manner, the adhesive applying step is completed.

[Connecting Step]

Then, as illustrated by an arrow "M2" of FIG. 6, the signal-line conductor exposure portion 40*a* and the outer conductor exposure portion 40*b* of the cable for differential signal transmission 40 are made to approach the cable connection portion 30 of the cable connector 10. And, the outer conductor 43 of the cable for differential signal transmission 40 is arranged in the outer-conductor adhering portion 23*f* on which the conductive adhesive G has been applied, and besides, the respective signal line conductors 41 of the cable for differential signal transmission 40 are arranged in the respective protruding portions 22*b* of the respective signal line contacts 22. Here, in a state that the end portion of the insulator 42 is made to abut on the respective protruding ends 22*c* (see FIG. 3) of the respective signal line contacts 22, the cable for differential signal transmission 40 is positioned with respect to the cable connector 10. In this manner, the outer conductor 43 is adhered to the outer-conductor adhering portion 23*f* by the conductive adhesive G.

Subsequently, the respective signal line conductors 41 and the respective signal line contacts 22 (the respective protruding portions 22*b*) are electrically connected with each other by using an ultrasonic welder (not illustrated) under a state that the outer conductor 43 is adhered to the outer-conductor adhering portion 23*f*. More specifically, as illustrated by an arrow "M3" of FIG. 7, a jig "T" forming the ultrasonic welder is made to abut on the respective signal line conductors 41, and the jig T is oscillated at a high frequency. In this manner, the respective signal line conductors 41 and the respective protruding portions 22*b* are fixed to each other by welding, and the connecting step is completed.

Here, connection means for connecting between the respective signal line conductors 41 and the respective protruding portions 22*b* are desired to be connection means such as the above-described ultrasonic welding in which the cable connector 10 and the cable for differential signal transmission 40 are not exposed to a high temperature, and, for example, other connection means such as low-temperature solder can be also adopted.

Note that FIGS. 6 and 7 illustrate the connection procedure on only the one cable for differential signal transmission 40 side. However, the connection on the other cable for differential signal transmission 40 side is also similarly provided. As described above, as illustrated in FIG. 8, two cables for differential signal transmission 40 are electrically connected with the cable connector 10, so that the cable assembly CA is completed.

As described in detail, in the cable connector 10 according to the first embodiment, the outer-conductor adhering portion 23*f* which is protruded from the side wall portion 20*c* of the connector main body 20 and on which the outer conductor 43 is adhered by the conductive adhesive G is provided in the ground contact 23, and therefore, it is not required to conventionally swage the shield connection terminal so as to be along with the shape of the outer conductor 43, so that the elastic deformation of the cable for differential signal transmission 40 is suppressed, and the electric characteristics can be stabilized. Also, the conventional shield connection terminal is not required, and therefore, the connection work between the outer conductor 43 and the ground contact 23 can be simplified with reducing the number of parts. Further, the soldering connection work for electrically connecting the outer conductor 43 with the ground contact 23 is not required, either, and therefore, the thermal deformation of the cable for differential signal transmission 40 due to the exposure to the heat temperature is prevented.

Also, in the cable connector 10 according to the first embodiment, the ground contact 23 is extended in the longitudinal direction of the respective signal line contacts 22 so that the peripheries of the respective signal line contacts 22 are covered with the ground contact 23 except for apart thereof, and therefore, the radiation of the electromagnetic noises from the respective signal line contacts 22 toward outside is prevented, and the electric characteristics can be further stabilized.

Further, in the cable connector 10 according to the first embodiment, the respective signal line contacts 22 are protruded from the side wall portion 20*c* of the connector main body 20 toward the outer-conductor adhering portion 23*f*, and therefore, the respective signal line conductors 41 can be easily positioned with respect to the respective protruding portions 22*b*.

Next, a second embodiment of the present invention will be described in detail with reference to the drawings. Note that the parts having the same functions as those of the first embodiment are denoted by the same reference symbols, and detailed explanation thereof is omitted.

Figure 9:
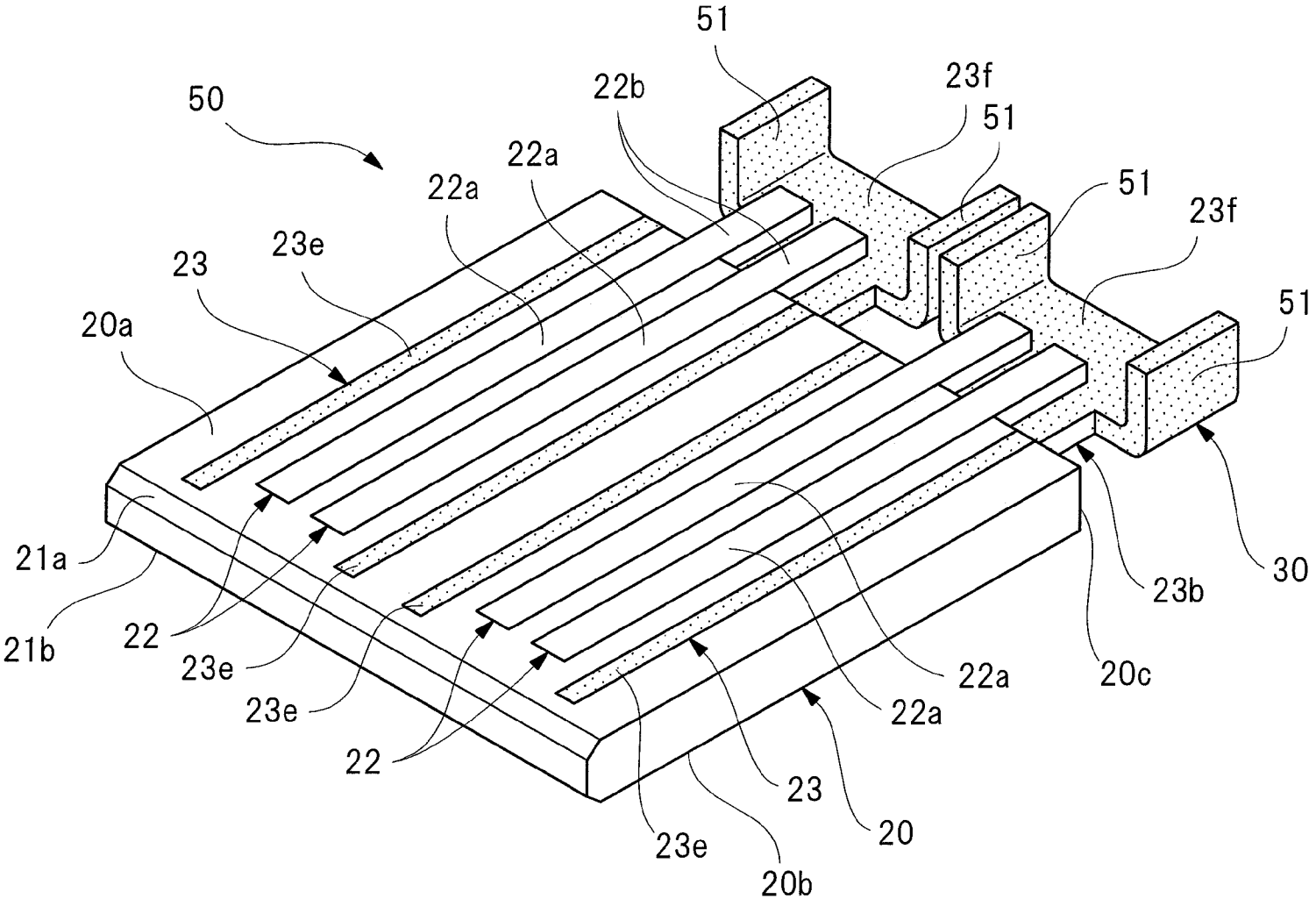
FIG. 9 is a perspective view of a cable connector according to a second embodiment as viewed from a front side.
Figure 10:
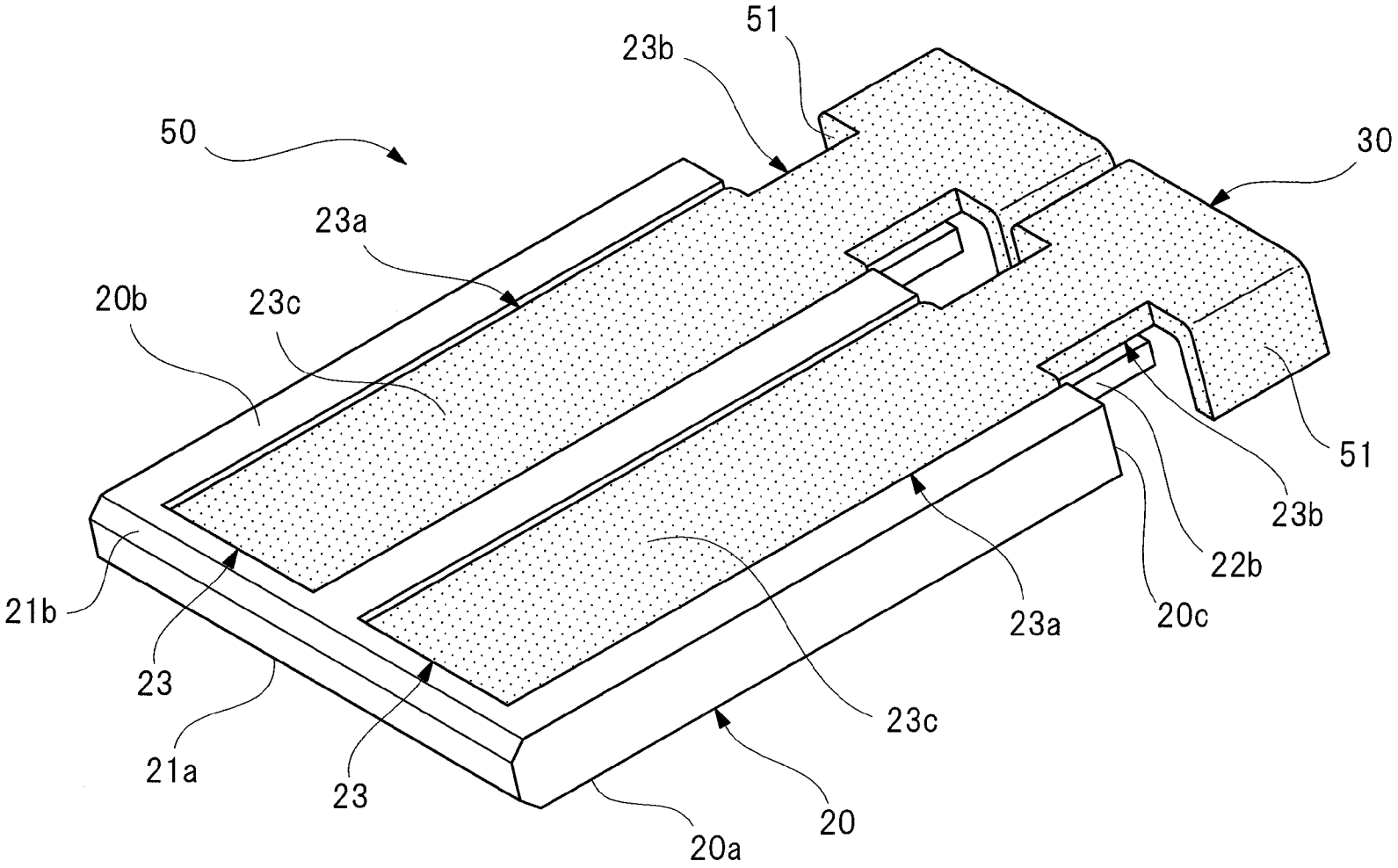
FIG. 10 is a perspective view of the cable connector of FIG. 9 as viewed from a rear side.
Figure 11:
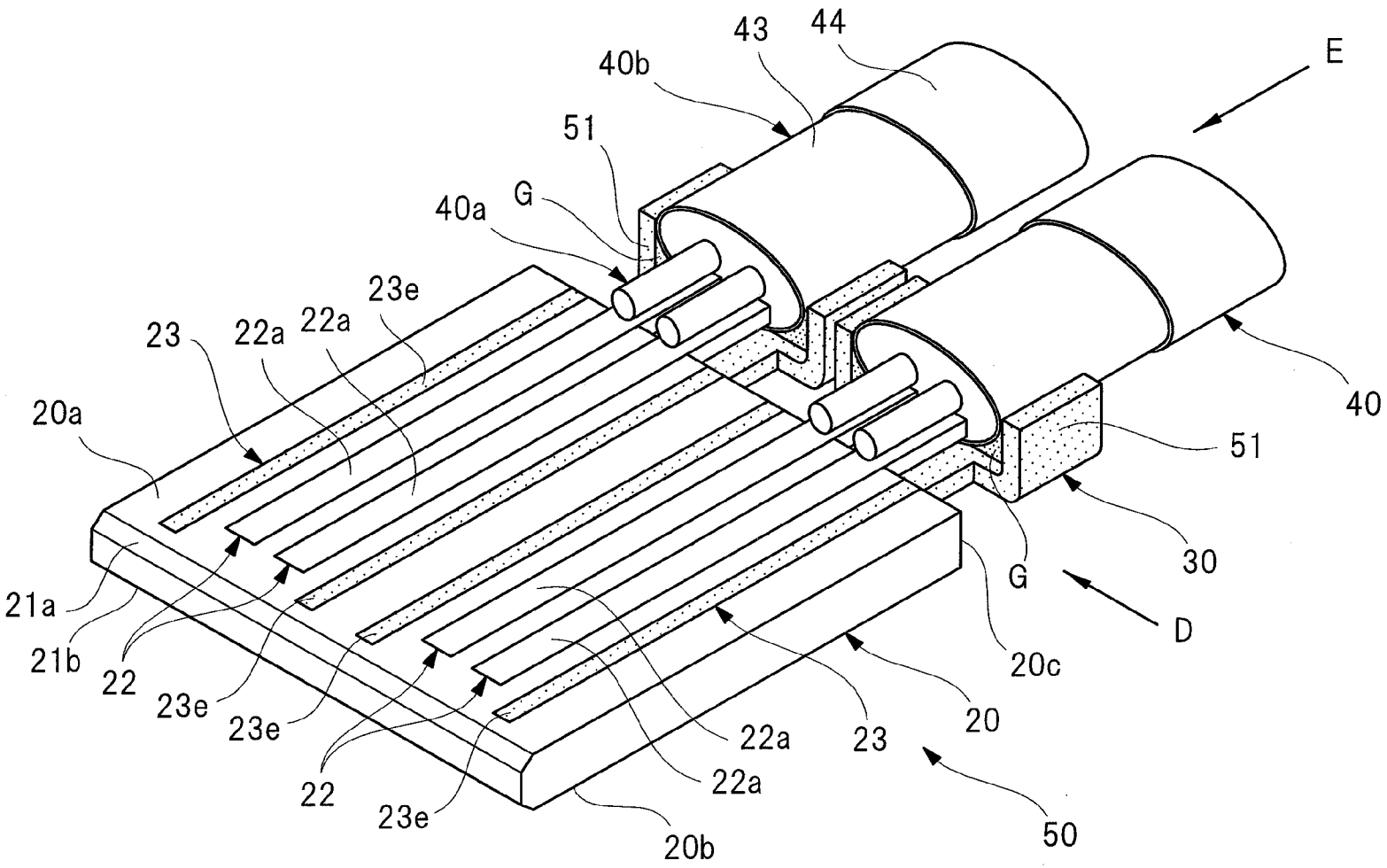
FIG. 11 is a perspective view illustrating a cable assembly according to the second embodiment.
Figure 12:
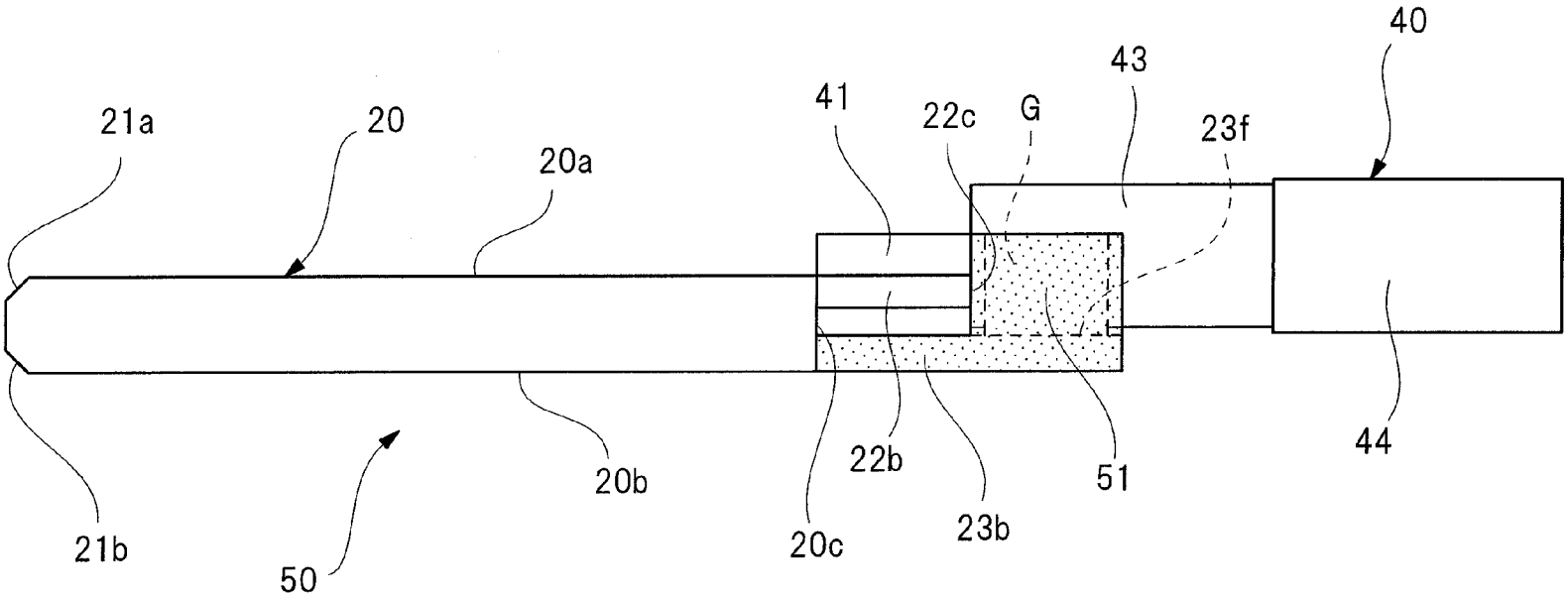
FIG. 12 is a side view on an arrow D in FIG. 11.
Figure 13:
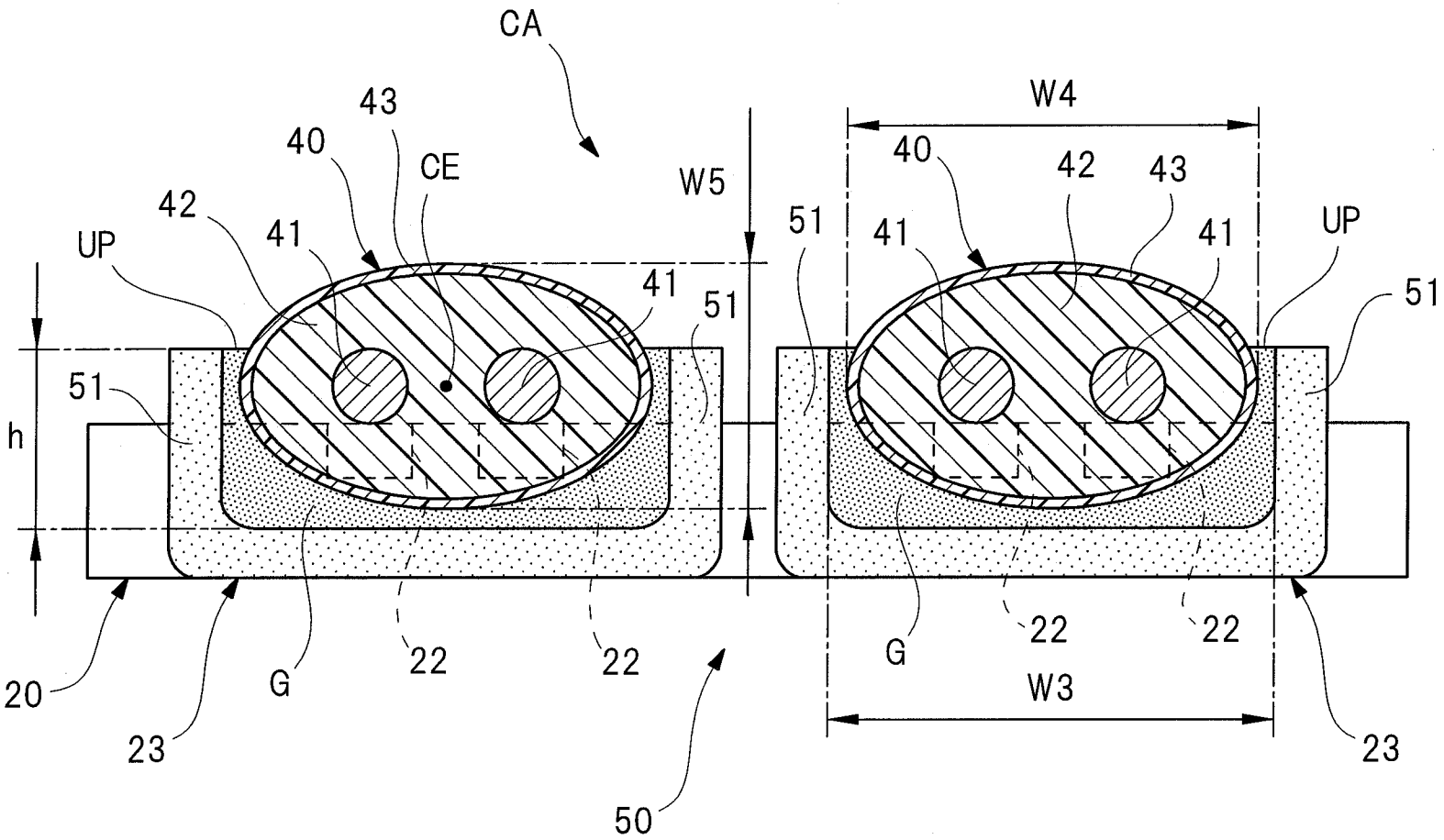
FIG. 13 is a side view on an arrow E in FIG. 11.

FIG. 9 is a perspective view of a cable connector according to the second embodiment as viewed from a front side, FIG. 10 is a perspective view of the cable connector of FIG. 9 as viewed from a rear side, FIG. 11 is a perspective view illustrating a cable assembly according to the second embodiment, FIG. 12 is a side view on an arrow "D" in FIG. 11, and FIG. 13 is a side view on an arrow "E" in FIG. 11.

As illustrated in FIG. 9 or 13, a cable connector 50 according to the second embodiment is different from the cable connector 10 according to the first embodiment (see FIG. 1) in only that a pair of positioning wall portions 51 formed integrally with each other are provided in the outer-conductor adhering portion 23*f* of each ground contact 23. The respective positioning wall portions 51 are provided opposite to each other on both sides of the outer-conductor adhering portion 23*f* in a lateral direction of the ground contact 23, and the positioning is performed so that the outer conductor 43 of the cable for differential signal transmission 40 is inserted between the respective positioning wall portions 51.

As illustrated in FIG. 13, a separated distance "W3" between the respective positioning wall portions 51 is set to a dimension in a length slightly longer than a dimension in a length "W4" of a long axis of the outer conductor 43 (which is a dimension in a width thereof) (W3>W4). In this manner, the positioning wall portions 51 guide the arrangement of the outer conductor 43 between the respective positioning wall portions 51. Here, even if the outer conductor 43 is arranged to be shifted closer to one of the respective positioning wall portions 51, the respective signal line conductors 41 are securely in contact with the respective signal line contacts 22.

A dimension in a height "h" of each of the positioning wall portions 51 is set to be higher than a half of a dimension in a length "W5" which is a dimension in a length of a short axis of the outer conductor 43 (which is a dimension in a thickness thereof) (h>(W5)/2). In this manner, as illustrated in FIG. 13, if the conductive adhesive G is filled in a space formed by the respective positioning wall portions 51 and the outer-conductor adhering portion 23*f*, an upper-surface portion "UP" of the conductive adhesive G is arranged at a position beyond a center portion "CE" of the cable for differential signal transmission 40.

Note that the shape of the ground contact 23 according to the second embodiment as illustrated can be also easily formed by performing the pressing work once so that the punching and the forming are simultaneously performed.

Even in the cable connector 50 according to the second embodiment formed as described above, the same function effect as that of the above-described first embodiment can be achieved. In addition to this, in the second embodiment, the electric connection between the outer conductor 43 and the conductive adhesive G can be further robust, and the electric characteristics can be further stabilized. Also, an adhering area between the outer conductor 43 and the conductive adhesive G can be increased, and therefore, the cable for differential signal transmission 40 can be hard to detach from the outer-conductor adhering portion 23*f*.

Next, a third embodiment of the present invention will be described in detail with reference to the drawings. Note that the parts having the same functions as those of the first embodiment are denoted by the same reference symbols, and detailed explanation thereof is omitted.

Figure 14:
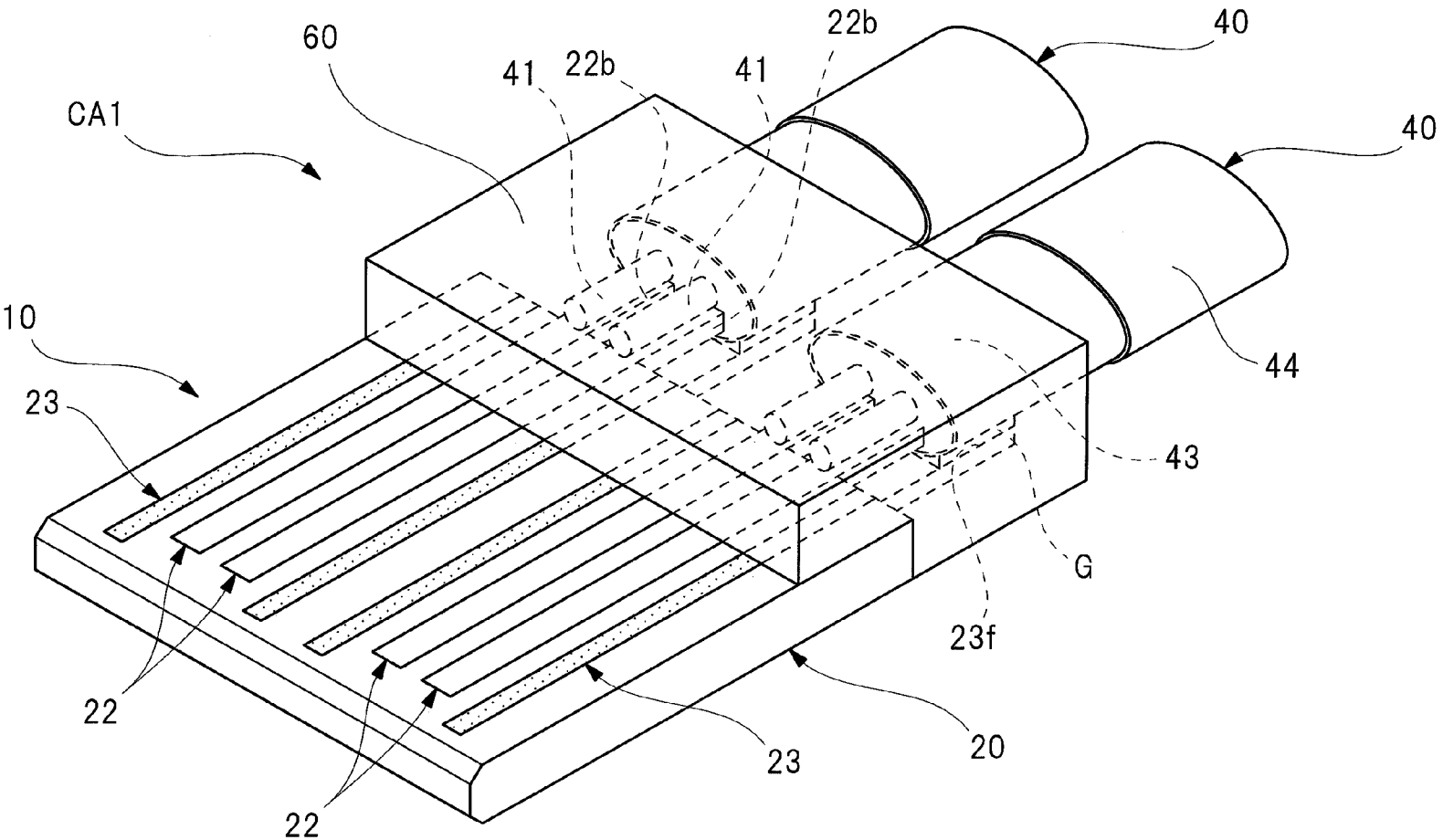
FIG. 14 is a perspective view illustrating a cable assembly according to a third embodiment.

FIG. 14 illustrates a perspective view illustrating a cable assembly according to the third embodiment.

As illustrated in FIG. 14, a cable assembly "CA1" according to the third embodiment is different from the cable assembly CA according to the first embodiment (see FIG. 6) in only that the connection portion between the respective signal line conductors 41 and the respective protruding portions 22*b* and the connection portion between the outer conductor 43 and the outer-conductor adhering portion 23*f* are solidified by, for example, thermosetting epoxy resin as the insulating material. More specifically, the peripheries of the respective signal line conductors 41 and the respective protruding portions 22*b* and the peripheries of the outer conductor 43 and the outer-conductor adhering portion 23*f* are solidified by the epoxy resin in a substantially rectangular parallelepiped shape, so that a mold resin portion 60 is formed.

Here, the mold resin portion 60 is formed by performing the above-described [Connecting Step] followed by [Mold Forming Step] using a molding machine (not illustrated). The molding machine using in the [Mold Forming Step] is provided with, for example, an upper mold and a lower mold, and the cable assembly CA illustrated in FIG. 6 is set in these upper and lower molds, and then, the molten epoxy resin is filled in a cavity formed of the set upper and lower molds, so that the cable assembly CA1 (see FIG. 14) integrally formed with the mold resin portion 60 can be formed.

Even in the cable assembly CA1 according to the third embodiment formed as described above, the same function effect as that of the above-described first embodiment can be achieved. In addition to this, in the third embodiment, the connection portion between the cable connector 10 and each cable for differential signal transmission 40 can be protected by the mold resin portion 60 under a state that the outer conductor 43 is arranged in the outer-conductor adhering portion 23*f*. Therefore, the connection portion between the cable connector 10 and each cable for differential signal transmission 40 is protected from moisture, dusts, and others, so that excellent electric connection can be maintained over a long period of time.

Next, a fourth embodiment of the present invention will be described in detail with reference to the drawings. Note that the parts having the same functions as those of the first embodiment are denoted by the same reference symbols, and detailed explanation thereof is omitted.

Figure 15:
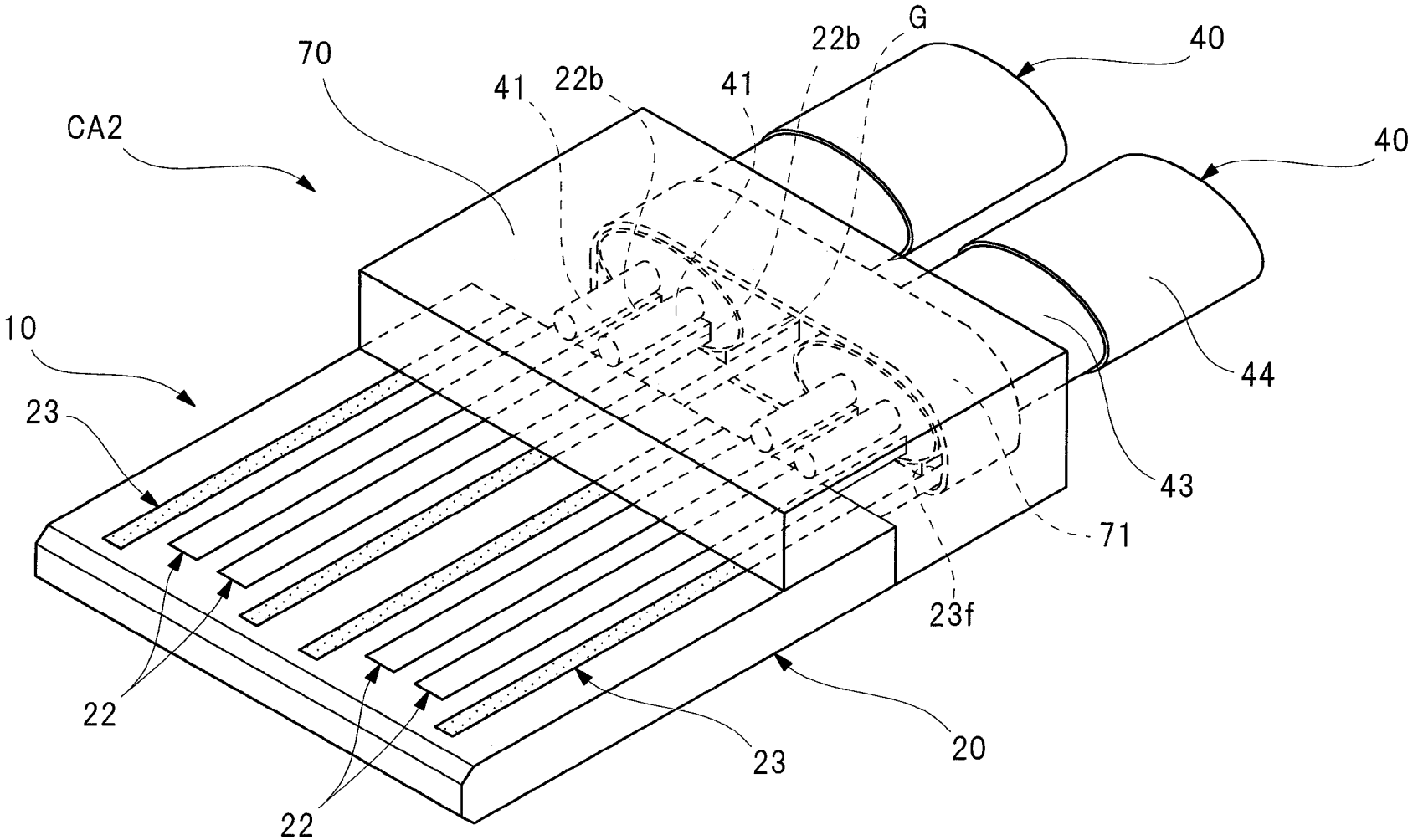
FIG. 15 is a perspective view illustrating a cable assembly according to a fourth embodiment.

FIG. 15 illustrates a perspective view illustrating a cable assembly according to the fourth embodiment.

As illustrated in FIG. 15, a cable assembly CA2 according to the fourth embodiment is provided with a mold resin portion 70 as similar to the cable assembly CA1 according to the above-described third embodiment (see FIG. 14). The mold resin portion 70 is formed as similar to the mold resin portion 60 of the cable assembly CA1. However, a copper tape (tape) 71 having conductive property is embedded inside the mold resin portion 70, and the copper tape 71 is wound in the peripheries of the respective outer conductors 43 and the respective outer-conductor adhering portions 23*f*. And, the copper tape 71 is wound at a previous stage of the [Mold Forming Step], that is, a stage previous to the setting of the cable assembly CA illustrated in FIG. 6 in the upper and lower molds and the formation of the mold resin portion 70. Note that not only the copper tape 71 but also, for example, a tape made of an aluminum foil as a base material can be used. Briefly speaking, the metal material is not specified as long as having the conductive property.

Even in the cable assembly CA2 according to the fourth embodiment formed as described above, the same function effect as that of the above-described first embodiment can be achieved. In addition to this, in the fourth embodiment, the mold resin portion 70 can be formed under a state that the connection portion between the cable connector 10 and each cable for differential signal transmission 40 is fixed stronger than that of the cable assembly CA1 of the third embodiment. Therefore, a yield of the cable assembly CA2 can be further improved. Also, the electric connection between the outer conductor 43 and the outer-conductor adhering portion 23*f* can be further stabilized, and, as a result, the electric characteristics can be further stabilized.

It is needless to say that the present invention is not limited to each of the above-described embodiments and various modifications and alterations can be made within the scope of the present invention. For example, the above-described fourth embodiment describes the case that the mold resin portion 70 is formed under the state of the winding of the copper tape 71. However, the present invention is not limited to this, and only the copper tape 71 may be wound with eliminating the mold resin portion 70.

Also, in the cable connector 50 according to the above-described second embodiment, the mold resin portion may be formed under a state that each cable for differential signal transmission 40 is connected as illustrated in FIG. 14, and the mold resin portion may be formed as winding the copper tape as illustrated in FIG. 15. Further, only the copper tape may be wound.

What is claimed is:

1. A cable connector electrically connected with a cable for differential signal transmission including: a pair of signal line conductors; an insulator provided in peripheries of the respective signal line conductors; and an outer conductor provided in periphery of the insulator, the cable connector comprising:

a connector board made of an insulating material;

a pair of signal line contacts which are provided in the connector board and are electrically connected with the respective signal line conductors;

a ground contact which is provided in the connector board and is electrically connected with the outer conductor, wherein the ground contact is extended in a longitudinal direction of the respective signal line contacts so that peripheries of the respective signal line contacts except for a part thereof are covered with the ground contact; and an outer-conductor adhering portion which is provided in the ground contact, is protruded from a side wall portion of the connector board, and is adhered with the outer conductor by a conductive adhesive.

2. The cable connector according to claim 1, wherein the respective signal line contacts are protruded from the side wall portion of the connector board toward the outer-conductor adhering portion.

3. The cable connector according to claim 1 further comprising a positioning wall portion for positioning the outer conductor provided in the outer-conductor adhering portion.

4. The cable connector according to claim 1, wherein peripheries of the outer-conductor adhering portion and the outer conductor are solidified by an insulating material under a state that the outer conductor is arranged in the outer-conductor adhering portion.

5. The cable connector according to claim 1 further comprising a tape having conductive property wound in the peripheries of the outer-conductor adhering portion and the outer conductor.

6. A cable assembly comprising: a cable for differential signal transmission; and a cable connector electrically connected with the cable for differential signal transmission, the cable for differential signal transmission including:

a pair of signal line conductors;

an insulator provided in peripheries of the respective signal line conductors; and an outer conductor provided in periphery of the insulator, and the cable connector including:

a connector board made of an insulating material;

a pair of signal line contacts which are provided in the connector board and are electrically connected with the respective signal line conductors;

a ground contact which is provided in the connector board and is electrically connected with the outer conductor, wherein the ground contact is extended in a longitudinal direction of the respective signal line contacts so that peripheries of the respective signal line contacts except for a part thereof are covered with the ground contact; and an outer-conductor adhering portion which is provided in the ground contact, is protruded from a side wall portion of the connector board, and is adhered with the outer conductor by a conductive adhesive.

7. The cable assembly according to claim 6, wherein the respective signal line contacts are protruded from the side wall portion of the connector board toward the outer-conductor adhering portion.

8. The cable assembly according to claim 6 further comprising a positioning wall portion for positioning the outer conductor provided in the outer-conductor adhering portion.

9. The cable assembly according to claim 6, wherein peripheries of the outer-conductor adhering portion and the outer conductor are solidified by an insulating material under a state that the outer conductor is arranged in the outer-conductor adhering portion.

10. The cable assembly according to claim 6 further comprising a tape having conductive property wound in the peripheries of the outer-conductor adhering portion and the outer conductor.

11. A method of manufacturing a cable assembly comprising:

a cable preparing step of preparing a cable for differential signal transmission including a pair of signal line conductors, an insulator provided in peripheries of the respective signal line conductors, and an outer conductor provided in periphery of the insulator;

a cable-connector preparing step of preparing a cable connector including a connector board made of an insulating material, a pair of signal line contacts which are provided in the connector board and are electrically connected with the respective signal line conductors, a ground contact which is provided in the connector board and is electrically connected with the outer conductor, wherein the ground contact is extended in a longitudinal direction of the respective signal line contacts so that peripheries of the respective signal line contacts except for a part thereof are covered with the ground contact, and an outer-conductor adhering portion which is provided in the ground contact, is protruded from a side wall portion of the connector board, and is adhered with the outer conductor by a conductive adhesive;

an adhesive applying step of applying the conductive adhesive on the outer-conductor adhering portion; and a connecting step of arranging the outer conductor in the outer-conductor adhering portion on which the conductive adhesive has been applied and of arranging the respective signal line conductors in the respective signal line contacts so that the respective signal line conductors and the respective signal line contacts are electrically connected with each other.

12. The method of manufacturing the cable assembly according to claim 11, wherein the connecting step is followed by performing a mold forming step of solidifying the peripheries of the outer-conductor adhering portion and the outer conductor by an insulating material.

* * * * *